US006135552A

United States Patent [19]

Waguri

[11] Patent Number: 6,135,552

[45] Date of Patent: Oct. 24, 2000

[54] ROCKING CHAIR DEVICE

[75] Inventor: Tatsuzo Waguri, Aichi, Japan

[73] Assignees: Yasushi Waguri; Hisao Yamada, both of Aichi, Japan

[21] Appl. No.: 09/296,649

[22] Filed: Apr. 23, 1999

[30] Foreign Application Priority Data

Apr. 4, 1997 [JP] Japan ..... 10-243836
Feb. 19, 1999 [JP] Japan ..... 11-040869

[51] Int. Cl.[7] ..... A47C 15/00

[52] U.S. Cl. ..... 297/245; 297/344.11; 601/98; 601/101; 600/38; 128/845

[58] Field of Search ..... 297/344.11, 245, 297/246, 247, 260.2; 128/845; 600/38; 601/93, 90, 101, 98

[56] References Cited

U.S. PATENT DOCUMENTS

| | | | |
|---|---|---|---|
| 769,466 | 9/1904 | Brendel | 601/90 |
| 812,997 | 2/1906 | Himburg | 297/344.11 |
| 2,895,468 | 7/1959 | Short | 601/93 |
| 3,831,140 | 8/1974 | Anderson, Jr. et al. | 340/52 |
| 4,189,708 | 2/1980 | Bryll | 340/64 |
| 4,412,533 | 11/1983 | Callahan | 601/98 X |
| 4,607,199 | 8/1986 | Krueger et al. | 364/424 X |
| 5,170,364 | 12/1992 | Gross et al. | 364/558 |
| 5,385,154 | 1/1995 | Fuhrman et al. | 128/845 |
| 5,453,080 | 9/1995 | Mitchum, Jr. | 600/38 |
| 5,572,903 | 11/1996 | Lee | 297/260.2 X |
| 5,875,779 | 3/1999 | Fuhrman et al. | 128/845 |

FOREIGN PATENT DOCUMENTS

| | | | |
|---|---|---|---|
| 522814 | 4/1931 | Germany | 601/98 |
| 380395 | 10/1985 | Germany | 601/98 |
| 8224274 | 9/1996 | Japan . | |
| 10-243836 | 9/1998 | Japan . | |

*Primary Examiner*—Peter M. Cuomo
*Assistant Examiner*—David E. Allred
*Attorney, Agent, or Firm*—Browdy and Neimark

[57] ABSTRACT

In a rocking chair device which assists sexual intercourse of old persons or handicapped persons to be made easy, especially wherein rapid rocking is secured in reasonable state and the safety is considered. The rocking chair device is provided with front and rear base plates which are made of a strong and non-flexible material such as band iron and are suspended and connected to a machine base frame and capable of being rocked in the front and rear direction, chairs which are arranged on the respective base plates through support columns and come close to each other, and a rocking device which rocks the chairs simultaneously in the direction of coming close to each other and getting away from each other. The rocking device supports a reversing shaft to the machine base frame at the intermediate position between both chairs in the orthogonal direction to the rocking direction of the chairs, and connects a rod moved linearly in the forward and rearward direction by rotation of a motor and the reversing shaft. Pressure detecting sensors are provided on the front surfaces of both chairs, and weight detecting sensors are assembled to both chairs.

Since the chairs are not laid directly on the ground but are installed on the suspended base plates thus in the aerial arrangement, the rocking in the front and rear direction can be performed smoothly and quietly and the rocking sound is little, and since the base plate is suspended by a strong and non-flexible member, the rapid rocking of the chair is possible. Also if legs are caught between both chairs, the rocking mechanism is stopped and the safety is maintained. Further since the rocking mechanism is not driven unless both persons sit on both chairs, the safety is maintained.

14 Claims, 4 Drawing Sheets

ROCKING CHAIR DEVICE

BACKGROUND OF THE INVENTION

The present invention relates to rocking chair devices, and more specifinally to a rocking chair device which assists sexial intercourse of old persons or handicapped persons to be easy.

In the prior art, such rocking chair devices have been much proposed. However, in almost devices, since chairs laid directly on the ground are rocked forward and rearward, there is defect in that the smooth rocking can not be obtained due to the resistance with the ground surface. In view of this point, in the Japanese patent application JP-A 10-243836 previously filed by the present inventor, chairs are suspended and arranged thereby the rocking in smooth and quiet state can be obtained. In the patent application, however, since the chairs are suspended by a chain or wire rod, there is a problem in that the rocking can not be transmitted well due to the flexture of such suspending member and the rapid rocking of 2~3 times in one second being reasonable can not be obtained.

SUMMARY OF THE INVENTION

Accordingly an object of the present invention is to provide a rocking chair device where the rocking can be performed quietly and smoothly and moreover the rapid rocking in the reasonable state can be obtained. Thereby sexual intercourse of old persons or handicapped persons especially becomes easy. Also when legs are caught, the rocking can be stopped immediately and the safety can be secured. Further since the rocking mechanism cannot be the driven unless both persons sit on both chairs respectively, so that safety can be secured.

Therefore a rocking chair device of the present invention is constituted by front and rear base plates which are made of a strong and non-flexible material such as band iron and are suspended and connected to a machine base frame and capable of being rocked in the front and rear direction, chairs which are arranged on the respective base plates through support columns and come close to each other, and a rocking device which rocks the chairs simultaneously in the direction of coming close to each other and getting away from each other. In addition, the rocking device may be constituted in that a reversing shaft can be reversed in the orthogonal direction to the rocking direction of chairs at the intermediate position of both chairs and is supported to the machine base frame, and the reversing shaft and both chairs are connected through cranks respectively and a reversing mechanism is provided so that the reversing shaft is reversed and rotated. Also one end of a joining plate fitted to the reversing shaft and the support column of one chair may be connected through the crank, and other end of the joining plate positioned at the opposite side of the shaft and the support column of other chair may be connected through the crank. Further a rod moved linearly in the forward and rearward direction by rotation of a motor is connected to the reversing shaft thereby a reversing mechanism may be constituted. Inside portions of both chairs opposite to each other may be arranged slanting downward a little. Also pressure detecting sensors may be provided on the front surfaces of both chairs, and weight detecting sensors may be assembled to both chairs.

Regarding action of the present invention, since the chairs are not installed directly to the ground but are installed on base plates suspended to the machine base frame, and the rocking is performed smoothly and quietly. Also since the base plate is suspended by a strong and non-flexible member, and the rapid rocking of the chair is possible. Further if legs are caught between the chairs, the rocking mechanism is stopped and the safety is maintained, and since the rocking mechanism cannot be driven unless both persons sit on both chairs, safety can be secured.

DESCRIPTION OF THE PREFERRED EMBODIMENT

Figure 1:
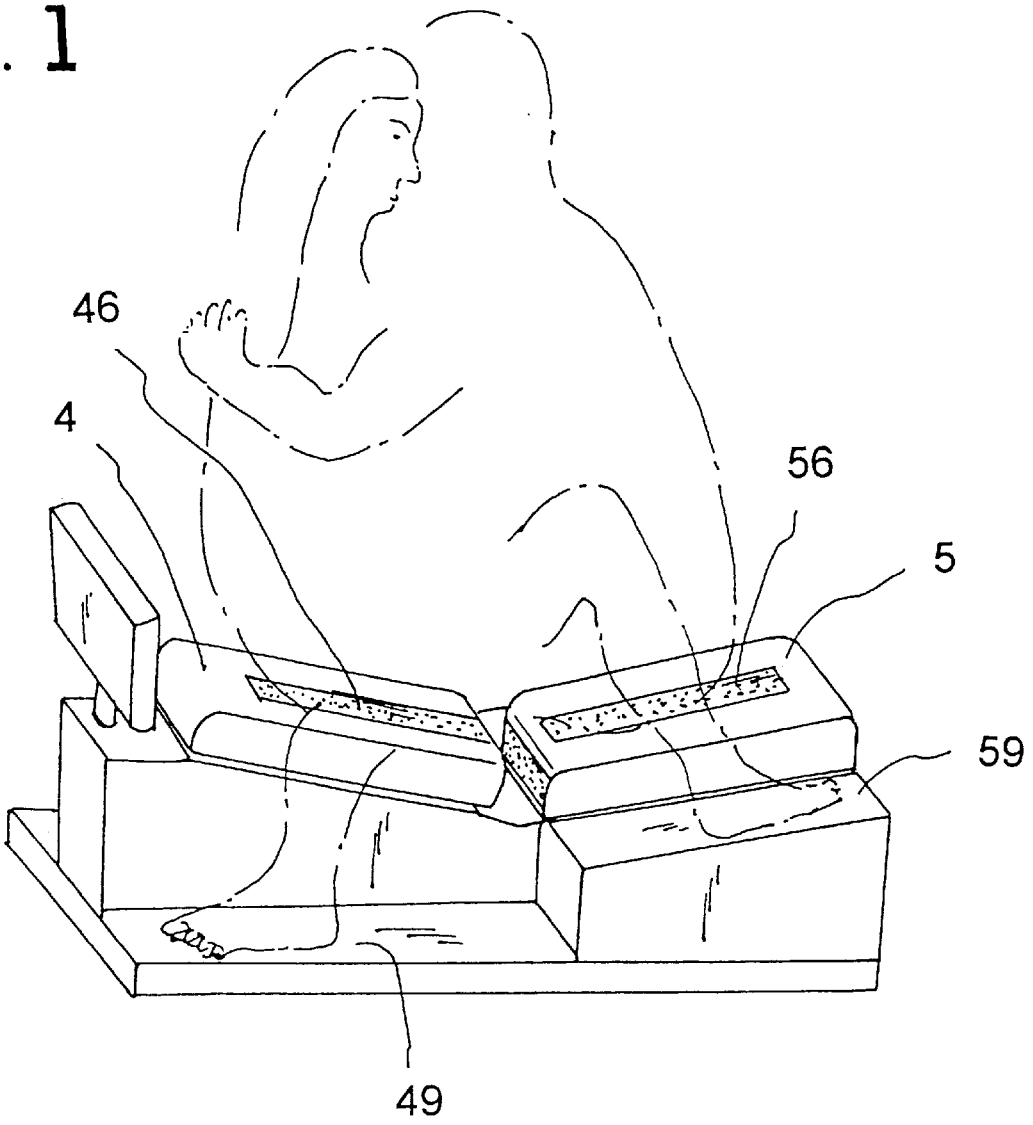
FIG. 1 is a perspective view showing a rocking chair device in an embodiment of the invention.
Figure 2:
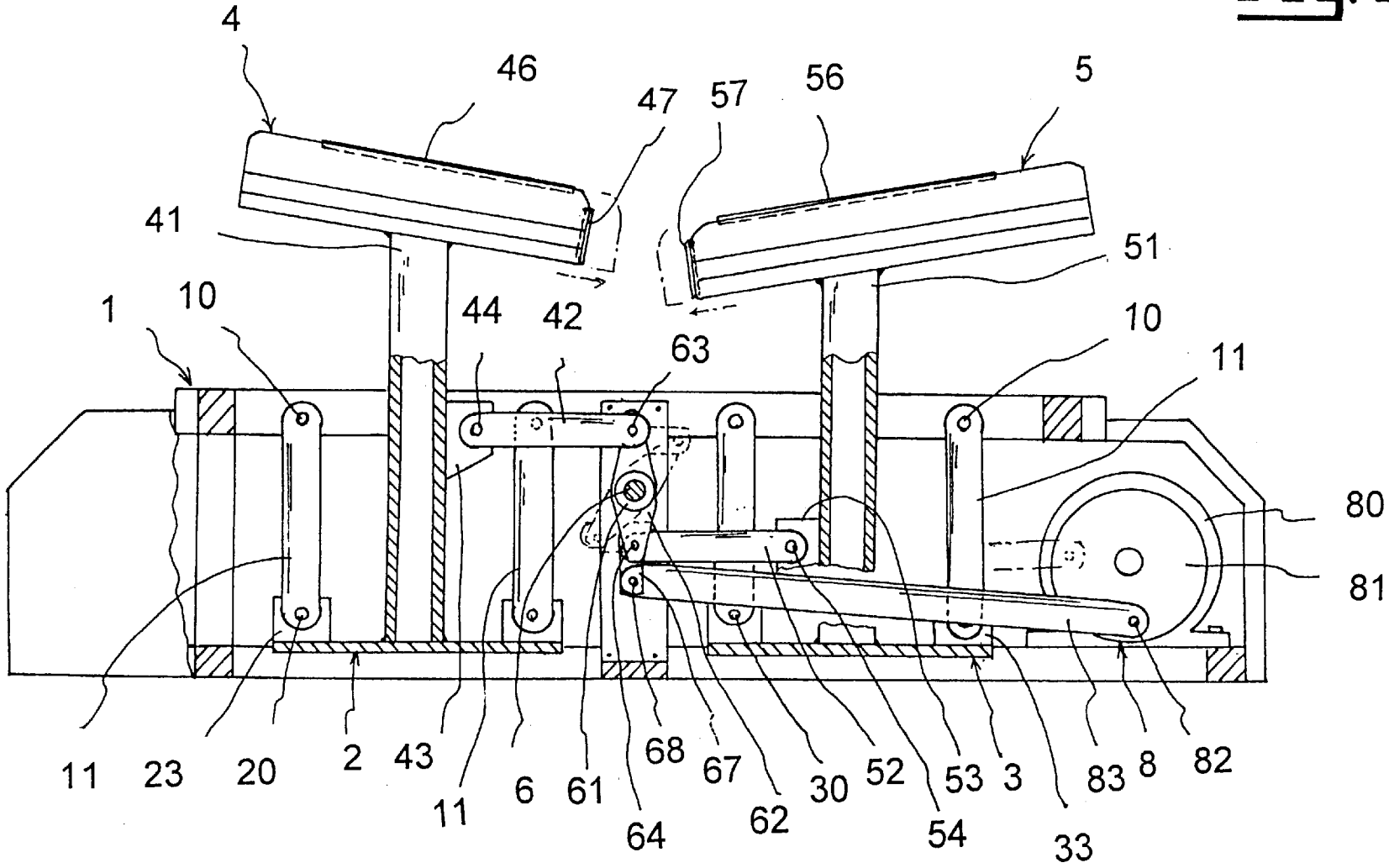
FIG. 2 is a longitudinal sectional side view partly cutaway of the device.
Figure 3:
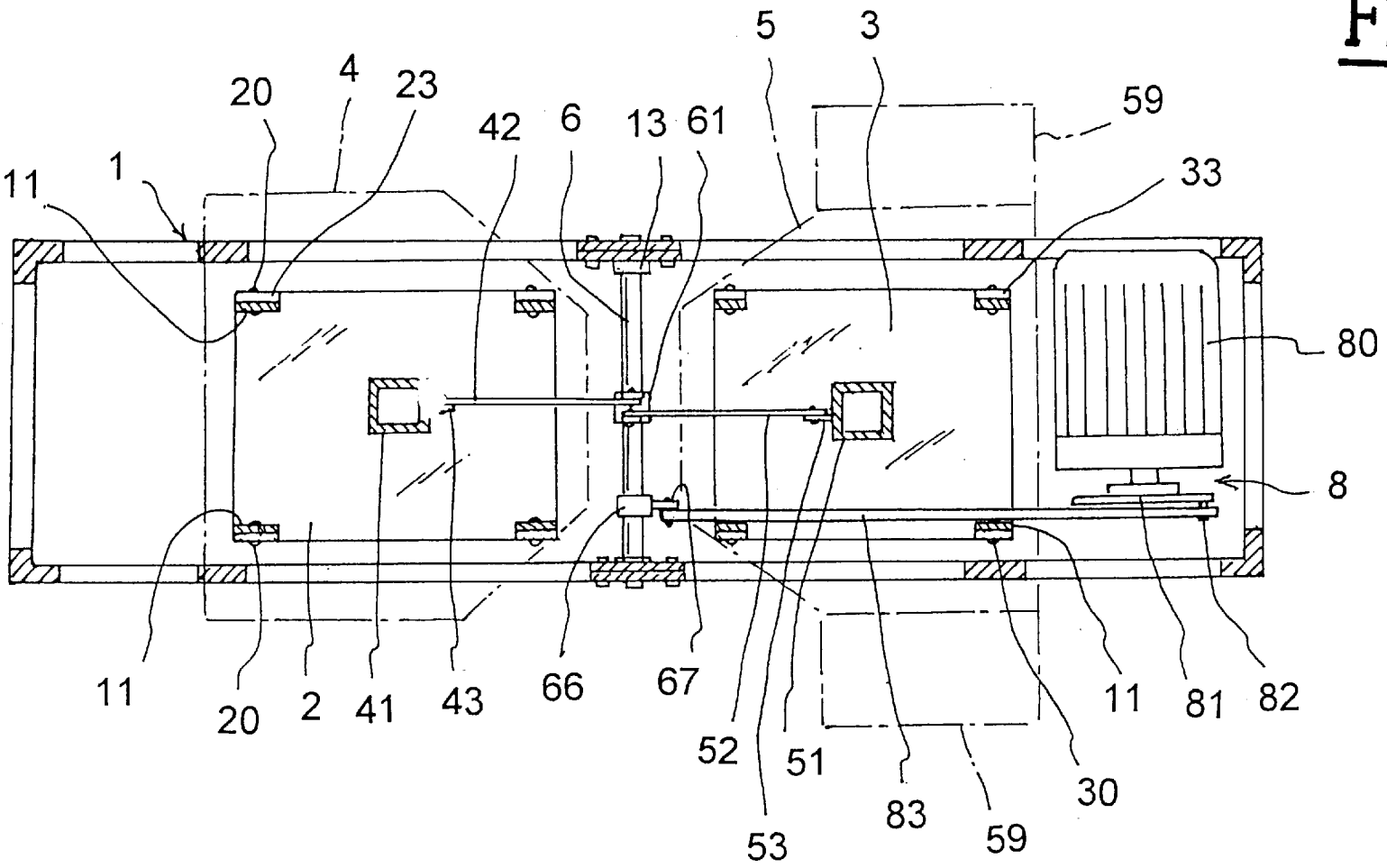
FIG. 3 is a lateral sectional plan view of the device.
Figure 4:
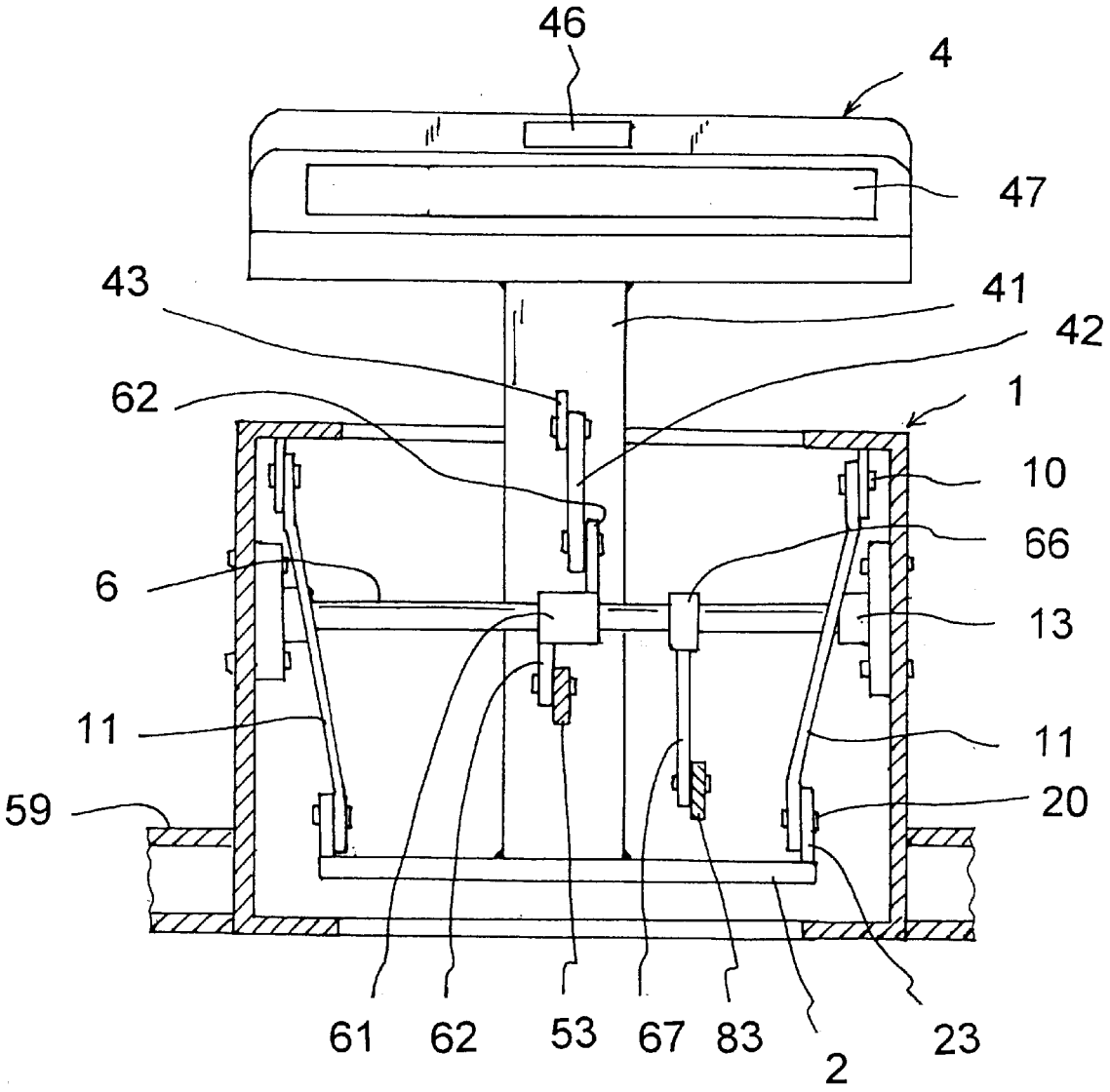
FIG. 4 is an enlarged longitudinal sectional front view of the device.

The present invention will be described in detail by way of embodiments shown in the accompanying drawings as follows. In the drawings, a machine base frame 1 is in rectangular shape longer in the lateral direction. Base plates 2, 3 are arranged at the front side and the rear side respectively spaced from each other and band iron members 11 are joined at upper end portions with the machine base frame 1 by pins 10 and at lower end portions with projection pieces with projection pieces 23, 33 at the corners of the base plates 2, 3 by pins 20, 30 respectively thereby the base plates 2, 3 are suspended to be movable in forward and rearward direction.

Chairs 4, 5 are slightly slanted downward at respective inside portions opposed to each other thereby both chairs 4, 5 are directed to the inside and are opposed and slightly spaced from each other. The chairs 4, 5 are fixed to upper end portions of support columns 41, 51 stood and fixed on center portions of the base plates 2, 3 respectively, and are rocked integrally with the rocking of the base plates 2, 3. In addition, footrests 49, 59 are provided on both sides of the chairs 4, 5, and one footrest 59 is arranged higher than other footrest 49.

At center portion of the machine base frame 1 which is the intermediate position between the support columns 41, 51 under the chairs 4, 5, a reversing shaft 6 is supported by bearings 13 in the orthogonal direction (right and left direction) to the rocking direction (front and rear direction) of the base plates 2, 3. A fitting cylinder 61 is fixed to the center of the shaft 6, and one end of a joining plate 62 connected to the fitting cylinder 61 and the support column 41 are joined via crank 42 whereas other end of the joining plate 62 positioned at the reverse side with respect to the shaft 6 and the support column 51 are joined via crank 52. That is, one end of the crank 42 is connected to a mounting piece 43 fixed to the support column 41 by a pin 44 and other end of the crank 42 is connected to one end of the joining plate 62 by a pin 63. Also one end of the crank 52 is connected to a mounting piece 53 fixed to the support column 51 by a pin 54, and other end of the crank 52 is connected to one end of the joining plate 62 by a pin 64. In addition, the cranks 42, 52 are preferably arranged in parallel to each other in the horizontal state.

In a reversing mechanism 8, one end of a rod 83 is connected to an eccentric shaft 82 of a rotary plate 81 rotated by a geared motor 80 installed at the front end of the machine base frame 1, and other end of the rod 83 is connected to a mounting piece 67 of a mounting ring 66 fixed to the shaft 6 by a pin 68.

Also weight detecting sensors 46, 56 in tape shape are assembled on the upper surface of the chairs 4, 5, and a wiring circuit is constituted so that the motor 80 is not drived unless the weight is applied to both chairs 4, 5.

Further pressure detecting sensors 47, 57 in tape shape are provided on the front surfaces of both chairs 4, 5 opposed to each other, and a control circuit is constituted so that the driving of the motor 80 is stopped on detectring the applied pressure.

Action of this embodiment in such constitution will be described. First, woman sits on the chair 4 at the rear side and man sits on the chair 5 at the front side and the attitude for the sexual intercourse is taken (refer to FIG. 1). In this state, the drive switch of the motor 80 is turned on. Then the eccentric shaft 82 is rotated by the rotation of the motor 80, and the rod 83 is moved forward and rearward. Since the shaft 6 is reversed and rotated repeatedly in a range of about 90 degrees, the cranks 42, 52 are moved forward and rearward in reverse directions from each other and the support columns 41, 51 are rocked forward and rearward thereby the chairs 4, 5 are rocked. That is, the chairs 4, 5 simultaneously repeat the operation of coming close to each other or getting away from each other thereby they are rocked forward and rearward.

According to this embodiment, since the chairs are not laid directly on the ground but are installed on the suspended base plates 2, 3 thus in the aerial arrangement, the rocking can be performed smoothly and the rocking sound becomes little. Particulely since the base plates 2, 3 are suspended by the band iron member 11 which is strong and is not flexible, the connection state of the chairs 4, 5 is secured and the rocking can be securely transmitted and the rapid rocking can be intended. If the base plates 2, 3 are suspended by a flexible substance such as a chain, the rocking force is absorbed by the flexible substance and the smooth rocking is not produced. In this embodiment, the rocking of two times in one second can be intended.

Also since one shaft 6 is rotated and reversed thereby the cranks 42 and 52 are moved in reverse direcrions from each other, the rocking of the chairs 4, 5 is synchronized and the suitable rocking can be obtained.

Further if such state occurs that legs are caught in the rocking chair device, the pressure detecting sensors 47, 57 assembled to the front surfaces of the chairs 4, 5 immediately detect the pressure and the rotation of the motor 80 is stopped. Consequently the safety is held in such state.

Also according to the weight detecting sensors 46, 47 assembled on the upper surfaces of the chairs 4, 5, since the motor 80 is not driven unless man and woman sit on both chairs 4, 5 respectively, the rocking does not occur at the preparatory stage before sitting of both persons thus the safety is held. That is, the motor 80 does not become the drive wait state before both persons sit on both chairs 4, 5 respectively.

Although the embodiment is constituted as above described, the present invention is not limited to this embodiment but the technical modification may be done without departing from the scope of claims. For example, any shape or constitution of the base plate may be used, and the suspending member may be made of not only band iron but also steel pipe or the like as long as it is a strong and non-flexible material. Also the chair may be in any shape or constitution, and the joining structure of the chair with the base plate is arbitrary. Further the structure of the rocking device for rocking the chairs in the directions of coming close to each other and getting away from each other simultaneously is arbitrary. Also when a reversing mechanism for reversing and rocking the reversing shaft is adopted, the structure of the reversing mechanism is not limited.

In addition, pressure detecting sensors provided on the front surfaces of both chairs are not limited in the configuration, and also configuration of weight detecting sensors assembled on upper surfaces of chairs are arbitrary where a rocking mechanism is not driven unless weight is applied to both chairs.

The chairs are not laid directly on the ground but are installed on the suspended base plates thus in the aerial arrangement, the rocking can be performed smoothly and quietly and the rocking sound is little. Since the base plates are suspended by a strong and non-flexible member, the rapid rocking of the chair can be performed suitably.

The rocking of the chairs is synchronized and the suitable rocking can be intended.

The reversing mechanism can be operated securely.

The user can take a comfortable position.

When legs are caught between both chairs, the rocking can be stopped and the safety is maintained.

The rocking mechanism cannot be driven unless both persons sit on both chairs respectively, the safety is held.

What is claimed is:

1. A rocking chair device comprising:

front and rear base plates made of a strong and non-flexible material, said base plates being suspended and connected to a machine base frame and capable of being rocked in a forward and rearward direction;

chairs arranged on the respective base plates through support columns and coming close to each other; and a rocking device for rocking a chairs simultaneously in the direction of coming close to each other and getting away from each other wherein a reversing shaft is rotatably supported on the machine base frame on an axis orthogonal to the rocking direction of the chairs at an intermediate position relative to both chairs, and the reversing shaft and both chairs are connected through cranks respectively and a reversing mechanism is provided so that the reversing shaft is reversed and rotated.

2. A rocking chair device as set forth in claim 1, wherein a joining plate is fitted to the reversing shaft and has an end connected to the support column of one of the chairs through the respective crank, and another end of the joining plate positioned at the opposite side of the reversing shaft is connected to the support column of the other chair through the other respective crank.

3. A rocking chair device as set forth in claim 2, wherein pressure detecting sensors are provided on front surfaces of both chairs, and if legs are caught between both chairs, the reversing mechanism is stopped.

4. A rocking chair device as set forth in claim 3, wherein weight detecting sensors are assembled to both chairs, and when persons sit on both chairs respectively, the reversing mechanism becomes capable of being driven.

5. A rocking chair device as set forth in claim 2, wherein weight detecting sensors are assembled to both chairs, and when persons sit on both chairs respectively, the reversing mechanism becomes capable of being driven.

6. A rocking chair device as set forth in claim 3, wherein a rod moved linearly in the forward and rearward direction by rotation of a motor is connected to the reversing shaft thereby a reversing mechanism is constituted.

7. A rocking chair device as set forth in claim 6, wherein pressure detecting sensors are provided on front surfaces of both chairs, and if legs are caught between both chairs, the motor is stopped.

8. A rocking chair device as set forth in claim 7, wherein weight detecting sensors are assembled to both chairs, and when persons sit on both chairs respectively, the reversing mechanism becomes capable of being driven.

9. A rocking chair device as set forth in claim 1, wherein pressure detecting sensors are provided on front surfaces of both chairs, and if legs are caught between both chairs, the rocking device is stopped.

10. A rocking chair device as set forth in claim 9, wherein weight detecting sensors are assembled to both chairs, and when persons sit on both chairs respectively, the rocking device becomes capable of being driven.

11. A rocking chair device as set forth in claim 1, wherein weight detecting sensors are assembled to both chairs, and when persons sit on both chairs respectively, the rocking device becomes capable of being driven.

12. A rocking chair device as set forth in claim 1, wherein pressure detecting sensors are provided on front surfaces of both chairs, and if legs are caught between both chairs, the reversing mechanism is stopped.

13. A rocking chair device as set forth in claim 1, wherein inside portions of both chairs opposite to each other are arranged slanting downward toward each other.

14. A rocking chair device as set forth in claim 1, wherein a rod moved linearly in the forward and rearward direction by rotation of a motor is connected to the reversing shaft thereby a reversing mechanism is constituted.

* * * * *